United States Patent [19]

McCormick et al.

[11] Patent Number: 4,781,250

[45] Date of Patent: Nov. 1, 1988

[54] PRESSURE ACTUATED CLEANING TOOL

[75] Inventors: William H. McCormick, Plano; Charles C. Cobb, Lewisville; Malcolm N. Council, Richardson, all of Tex.

[73] Assignee: Otis Engineering Corp., Dallas, Tex.

[21] Appl. No.: 132,777

[22] Filed: Dec. 14, 1987

[51] Int. Cl.[4] ..... E21B 37/00

[52] U.S. Cl. ..... 166/240; 134/167 C; 166/312

[58] Field of Search ..... 166/311, 312, 222, 223, 166/240, 72, 73, 170, 171, 177, 175, 77, 385, 384, 331; 299/16, 17; 175/424; 134/167 C, 168 C, 22.12

[56] References Cited

U.S. PATENT DOCUMENTS

| | | | |
|---|---|---|---|
| 3,285,485 | 11/1966 | Slator | 226/172 |
| 3,313,346 | 4/1967 | Cross | 166/352 |
| 3,559,905 | 2/1971 | Palynchuk | 242/54 |
| 3,720,264 | 3/1973 | Hutchison | 166/311 |
| 3,811,499 | 5/1974 | Hutchison | 166/67 |
| 3,829,134 | 8/1974 | Hutchison | 285/14 |
| 3,850,241 | 11/1974 | Hutchison | 166/222 |
| 3,958,641 | 5/1976 | Dill et al. | 166/312 |
| 4,088,191 | 5/1978 | Hutchison | 166/223 |
| 4,216,910 | 8/1980 | Kimbrough | 134/167 C |
| 4,321,965 | 3/1982 | Restarick et al. | 166/240 X |
| 4,349,073 | 9/1982 | Zublin | 166/312 |
| 4,355,685 | 10/1982 | Beck | 166/240 |
| 4,420,044 | 12/1983 | Pullin et al. | 166/322 |
| 4,441,557 | 4/1984 | Zublin | 166/312 |
| 4,442,899 | 4/1984 | Zublin | 166/312 |
| 4,518,041 | 5/1985 | Zublin | 166/312 |
| 4,583,592 | 4/1986 | Gazda et al. | 166/386 X |
| 4,625,799 | 12/1986 | McCormick et al. | 166/240 X |
| 4,694,908 | 9/1987 | Morris et al. | 166/902 X |
| 4,705,107 | 11/1987 | Council et al. | 166/170 |

FOREIGN PATENT DOCUMENTS

| | | | |
|---|---|---|---|
| 371983 | 5/1973 | U.S.S.R. | 134/167 C |

*Primary Examiner*—Stephen J. Novosad

*Attorney, Agent, or Firm*—Thomas R. Felger

[57] ABSTRACT

Apparatus for pressurized cleaning of flow conductors. The apparatus has a first mandrel and a second mandrel telescoped therein. A cleaning tool can be attached to the second mandrel. Changes in fluid pressure flowing through the mandrels will cause the second mandrel to rotate relative to the first mandrel. Rotation is used to direct fluid jets in the cleaning tool towards different portions of the interior of the flow conductor. Rotation of the cleaning tool can also be used for hydraulic drilling of deposits within the flow conductor.

6 Claims, 3 Drawing Sheets

PRESSURE ACTUATED CLEANING TOOL

This application is related to pending U.S. patent application Ser. No. 07/037,176 filed Apr. 10, 1987, now abandoned.

BACKGROUND OF THE INVENTION

1. Field of the Invention

This invention relates to the servicing of wells by use of coil tubing and more particularly to removal of scale and other downhole deposits from the inside diameter of well tubulars.

2. Description of Related Art

It has been common practice for many years to run a continuous reeled pipe (known extensively in the industry as "coil tubing") into a well to perform operations utilizing the circulation of treating and cleanout fluids such as water, oil, acid, corrosion inhibitors, hot oil, etc. Coil tubing, being continuous rather than jointed, is run into and out of a well with continuous movement of the tubing through use of a coil tubing injector.

Coil tubing is frequently used to circulate cleanout fluids through a well for the purpose of eliminating sand bridges, scale, and similar downhole obstructions. Often such obstructions are very difficult and occasionally impossible to remove because of the inability to rotate the coil tubing to drill out such obstructions. Turbo-type drills have been used but develop insufficient torque for many jobs. Various devices have been used to attempt removal of foreign material from the interior of the well tubing. This well tubing varies from unperforated and perforated tubulars to slotted or wire-wrapped well liners. Such well tubing often becomes plugged or coated with corrosion products, sediments and hydrocarbon deposits.

Wire brushes, scrapers, scratchers and cutters of various designs were among the first tools used to try to remove unwanted deposits. Some of these tools did not reach into the slots or perforations. Those with wires or feelers thin enough to enter the slot or perforation were often too thin to provide much cleaning force. Several types of washing tools are available which use pressurized jets of fluid in an attempt to dislodge undesired material from the well tubing. The development of jet cleaning has advanced from low velocity for use in cleaning and acidizing to abrasive particles suspended in high pressure fluids. Abrasives are used for cleaning flow conductors, but with results less than favorable since the flow conductors are sometimes eroded along with the foreign material plugging or coating the flow conductors.

U.S. Pat. No. 4,625,799 discloses a mechanically indexed cleaning tool. The apparatus of this patent led to the development of the present invention.

U.S. Pat. No. 3,285,485 which issued to Damon T. Slator on Nov. 15, 1966 discloses a device for handling tubing and the like. This device is capable of injecting reeled tubing into a well through suitable seal means, such as a blowout preventer or stripper, and is currently commonly known as a coil tubing injector.

U.S. Pat. No. 3,313,346 issued Apr. 11, 1967 to Robert V. Cross and discloses methods and apparatus for working in a well using coil tubing.

U.S. Pat. No. 3,559,905 which issued to Alexander Palynchuk on Feb. 2, 1971 discloses an improved coil tubing injector.

High pressure fluid jet systems have been used for many years to clean the inside diameter of well tubulars. Examples of such systems are disclosed in the following U.S. Pat. Nos. 3,720,264, 3,850,241, 4,441,557, 3,811,499, 4,088,191, 4,442,899, 3,829,134, 4,349,073, 4,518,041.

Outside the oil and gas industry, tubing cleaners have been used for many years to remove scale and other deposits from the inside diameter of tubes used in heat exchangers, steam boilers, condensers, etc. Such deposits may consist of silicates, sulphates, sulphides, carbonates, calcium, and organic growth. U.S. Pat. No. 4,705,107 discloses the use of such equipment to clean well tubulars downhole.

U.S. Pat. Nos. 4,583,592 issued Apr. 22, 1986 and 4,420,044 issued Dec. 13, 1983 show examples of a continuous J-slot or control slot used to manipulate components in a downhole well tool.

The preceding patents are incorporated by reference for all purposes within this application.

SUMMARY OF THE INVENTION

The present invention is directed towards improved methods and apparatus for cleaning well tubulars or flow conductors using coil tubing.

The present invention is an apparatus for cleaning flow conductors including but not limited to downhole tubing, casing, and flow lines. The apparatus may be attached to a flexible or rigid conduit such as coil tubing or small diameter pipe which is connected to a source of cleaning fluid. The cleaning fluid is pumped under pressure to the apparatus with a cleaning tool attached. Coil tubing with the apparatus attached is run into a flow conductor to the area to be cleaned.

The apparatus has an outer mandrel and an inner mandrel which is selectively rotated relative to the outer mandrel in part by control slots in response to fluid pressure changes. Longitudinal movement of the inner mandrel relative to the outer mandrel is translated by the control slots and indexing pins. Indexed rotation of the inner mandrel positions a cleaning tool attached thereto to clean different portions of the flow conductor.

The present invention eliminates the need to twist or rotate the coil tubing to ensure uniform cleaning of the inside diameter of the well flow conductor. The present invention is particularly useful when well conditions downhole limit the ability of longitudinal movement to rotate the cleaning tool.

One object of this invention is to provide a cleaning tool which indexingly rotates in response to cleaning fluid pressure changes thereby allowing fluid nozzles in the cleaning tool to direct cleaning fluid at different segments of the flow conductor.

Another object of this invention is to provide a cleaning tool which can be operated without twisting or rotating the tubing supplying the cleaning fluid to the cleaning tool.

The present invention allows selection of the amount of rotation that will result from each pressure change. Different control slot angles and spacing can be used to cause the inner mandrel to step or rotate a preselected amount.

Additional objects and advantages of the present invention will be readily apparent to those skilled in the art after studying the written description in conjunction with the drawings and claims.

DESCRIPTION OF THE PREFERRED EMBODIMENTS

Figure 1:
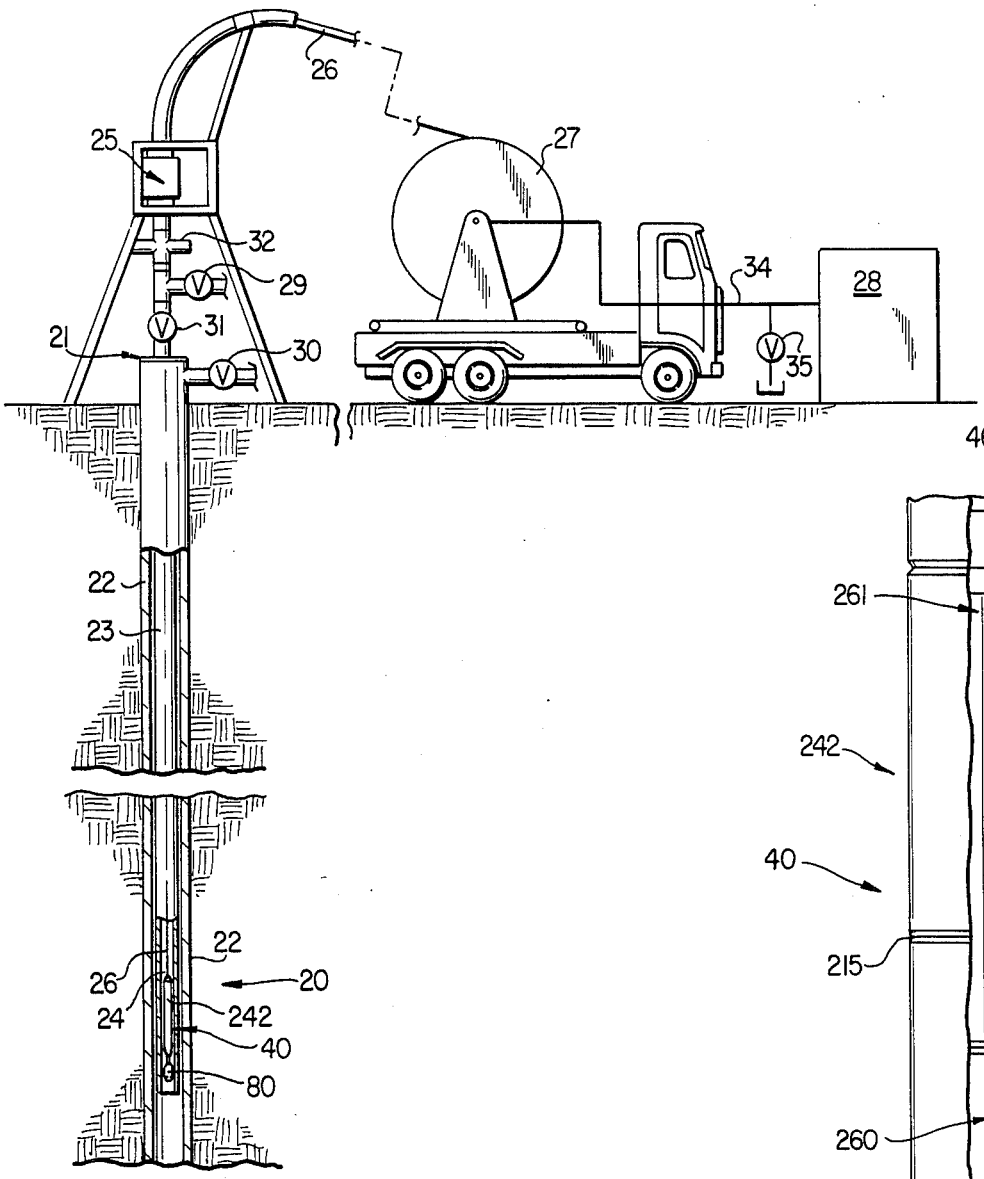
FIG. 1 is a schematic drawing, partially in elevation and partially in section with portions broken away, showing a coil tubing unit and cleaning tool removing deposits from the inside diameter of a well tubular.

In FIG. 1 well 20 extends from wellhead 21 to an underground hydrocarbon or fluid producing formation (not shown). Well 20 is defined in part by casing string or well flow conductor 22 with tubing string 23 disposed therein. The present invention can be used with other types of well tubulars or flow conductors including liners and dual production tubing strings. Also, the present invention is not limited to use in oil and gas wells.

During the production of formation fluids, various types of deposits may accumulate on the inside diameter of flow conductors 22 and 23. Examples of soft deposits are clay, paraffin, and sand. Examples of hard deposits 114 are silicates, sulphates, sulphides, carbonates and calcium. The present invention is particularly useful for removal of hard deposits found in some geothermal and oil wells but may be satisfactorily used to remove other types of deposits such as sand bridges.

Using conventional well servicing techniques, injector 25 can be mounted on wellhead 21. Continuous or coil tubing 26 from reel 27 is inserted by injector 25 into bore 24 of tubing 23. Well cleaning apparatus 40 is attached to the lower end of coil tubing 26 by a suitable connection (not shown). Manifold 28 includes the necessary pumps, valves, and fluid reservoirs to discharge high pressure cleaning fluid into bore 24 via coil tubing 26. Valves 29 and 30 can be used to control the return of spent cleaning fluid to the well surface. Wellhead valve 31 is used to control vertical access to and fluid communication with bore 24 of tubing string 23. Blowout preventers 32 are normally installed between wellhead 21 and injector 25 to block fluid flow during emergency conditions.

Manifold 28 is connected to reel 27 by cleaning fluid supply line 34. Regulating valve or dump valve 35 is provided in supply line 34. Valve 35 can be temporarily opened to momentarily decrease the pressure of cleaning fluid supplied from manifold 28 to coil tubing 26.

Figure 2:
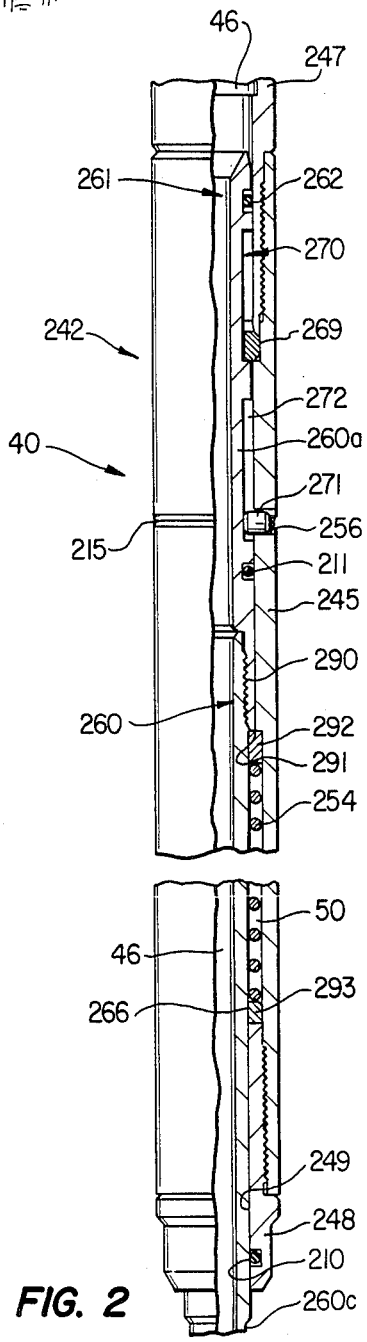
FIG. 2 is a drawing, partially in section and partially in elevation with portions broken away, showing an indexing tool incorporating the present invention.
Figure 3:
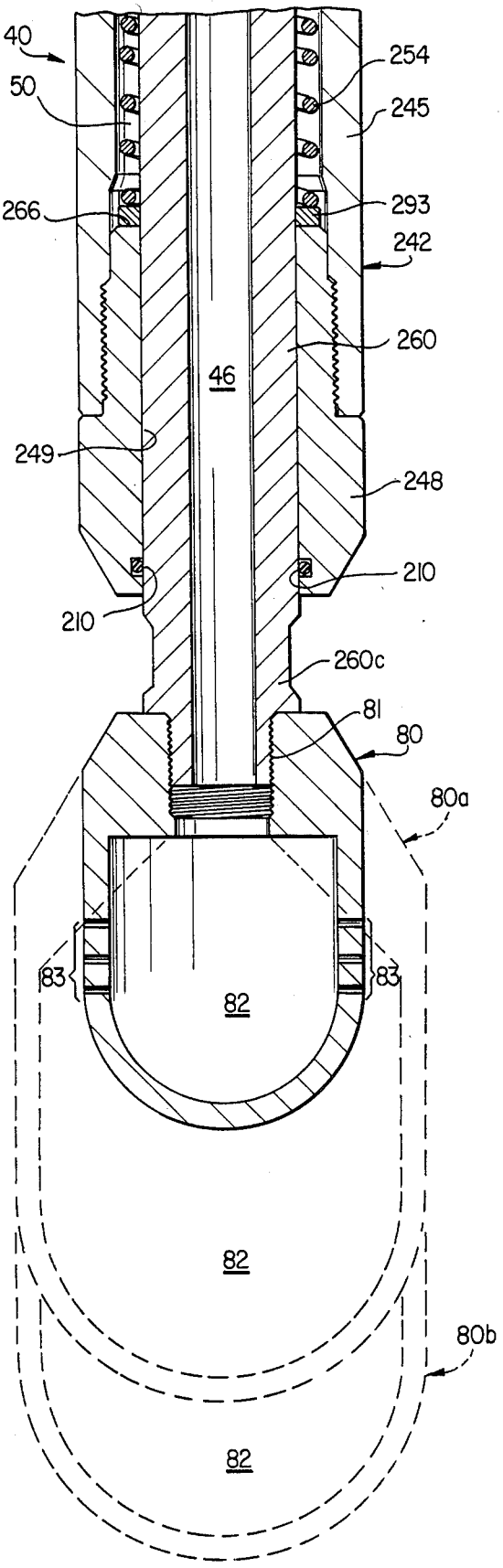
FIG. 3 is an enlarged drawing, partially in section and partially in elevation with portions broken away, showing the indexing tool of the present invention with alternative cleaning tools attached thereto.

As best shown in FIGS. 2 and 3, well cleaning apparatus 40 consists of two downhole well tools—indexing or rotating tool 242 and cleaning tool 80. Indexing tool 242 can rotate cleaning tool 80 in response to cleaning fluid pressure changes. Indexing tool 242 has first mandrel means 245 with second mandrel means 260 slidably disposed therein. First or outer mandrel means 245 is essentially a long hollow cylinder with longitudinal flow passageway 46 extending therethrough. First mandrel means 245 includes end cap 247 with longitudinal flow passageway 46 therethrough. End cap 247 provides means for connecting one end of first mandrel means 245 to coil tubing 26 which in turn connects longitudinal flow passageway 46 to a source of cleaning fluid. End cap 248 is attached to the other end of first mandrel means 245. End cap 248 has opening 249 sized to allow second mandrel means 260 to be slidably and rotatably disposed therein. Wiper ring 210 is carried by end cap 248 to lightly engage the exterior of second mandrel means 260 adjacent thereto. Wiper ring 210 does not form a fluid pressure barrier, but it does block sand or other debris from entering into annulus 50. Portion 260*c* of second mandrel means 260 extends longitudinally from end cap 248.

Figure 4:
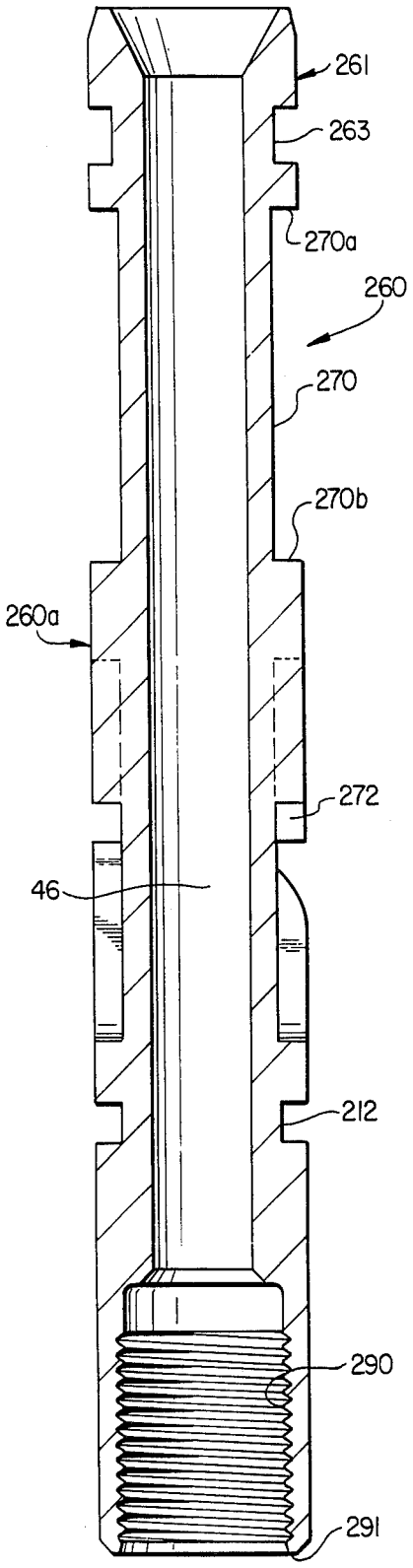
FIG. 4 is a drawing, partially in section and partially in elevation, showing a portion of the inner mandrel associated with the indexing tool of FIG. 2.
Figure 10:
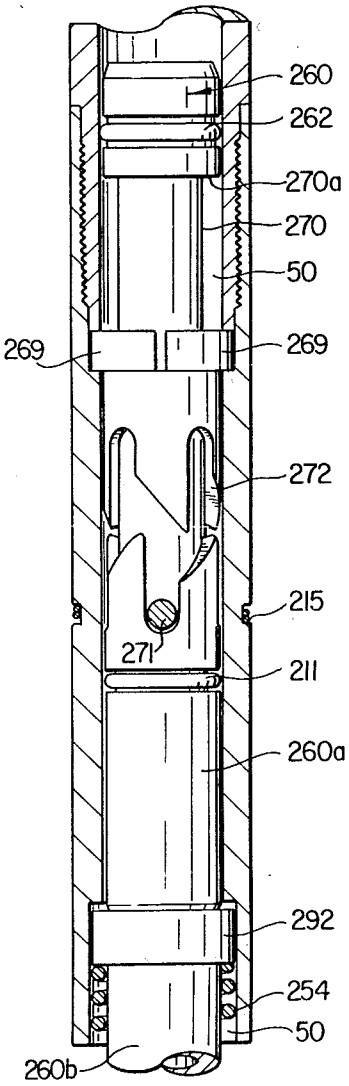
FIGS. 6–10 are schematic drawings, partially in section and partially in elevation, of the sequential steps as the indexing tool of FIG. 2 responds to fluid pressure changes to rotate its inner mandrel means relative to its outer mandrel means.
Figure 9:
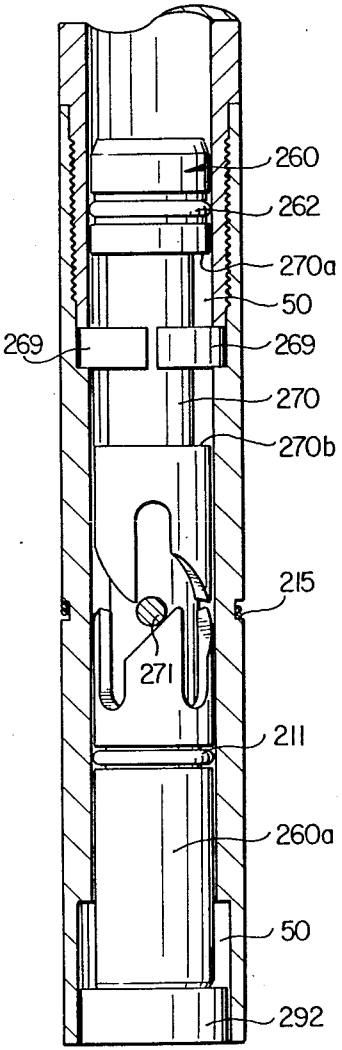

Second or inner mandrel means 260 is essentially a long, hollow cylinder. The outside diameter of second mandrel means 260 varies but is always less than the inside diameter of first mandrel means 245. This difference in diameters partially defines annulus 50 when second mandrel means 260 is disposed within first mandrel means 245. The difference in diameters also allows second mandrel means 260 to rotate and slide longitudinally relative to first mandrel means 245. For ease of manufacture and assembly, second mandrel means 260 has two subsections 260*a* and 260*b* engaged to each other by threads 290. Longitudinal flow passageway 46 also extends through second mandrel means 260. Wiper ring 211, similar to previously described wiper ring 210, is installed between first mandrel means 245 and second mandrel means 260 above spring 254. Groove 212 is machined in the exterior of subsection 260*a* to hold wiper ring 211. See FIG. 4.

Means for rotating second or inner mandrel means 260 relative to first mandrel means 245 in response to fluid pressure changes within longitudinal flow passageway 46 are disposed within annulus 50. The rotating means includes subsection 260*a* of inner mandrel 260, piston means 261 carried thereon, and biasing means or springs 254. Piston means 261 includes elastomeric seal 262 carried in recess 263 on the exterior of second mandrel means 260 to form a fluid barrier with the interior of first mandrel means 245 adjacent thereto. One side of piston means 261 is exposed to fluid pressure within longitudinal flow passageway 46. The other side of piston means 261 is exposed to fluid pressure within annulus 50. One or more ports 256 extend radially through first mandrel means 245 to equalize fluid pressure between annulus 50 and the exterior of first mandrel means 245. Thus, when fluid pressure in longitudinal flow passageway 46 exceeds fluid pressure in annulus 50, the difference in pressure creates a net force on piston means 261 to slide or extend second mandrel means 260 longitudinally relative to first mandrel means 245. Biasing means or spring 254 is carried between shoulder 266 on the interior of first mandrel means 245 and shoulder 291 of second mandrel means 260. Shoulder 291 is formed on second mandrel means 260 by the engagement of subsection 260*a* with subsection 260*b*.

Spring 254 provides means for biasing second mandrel means 260 to retract from its fully extended position. Spring 254 opposes the force of cleaning fluid pressure acting on piston means 261. Spacers 292 and 293 are also provided between the ends of spring 254 and shoulders 291 and 266 respectively. Spacers 292 and 293 can be varied to adjust the force produced by spring 254.

As shown in FIG. 2, split ring 269 is securely engaged with first mandrel means 245 and slidably disposed in large recess 270 on the exterior of second mandrel means subsection 260*a*. Recess 270 has a substantially reduced outside diameter as compared to the other portions of second mandrel means 260. Shoulders 270*a* and 270*b* cooperate with ring 269 to define the limits for longitudinal movement of second mandrel means 260 relative to first mandrel means 245. This movement is shown in FIGS. 6–10. Split ring 269 and recess 270 are sized to allow both rotation and longitudinal movement of second mandrel means 260 relative to first mandrel means 245.

Indexing pin 271 is carried by first mandrel means 245 in port means 256 and spaced longitudinally from split ring 269. Snap springs 215 are used to secure indexing pin 271 in port means 256. Indexing pin 271 is also slidably disposed in continuous J-slot or control slot 272. Control slot 272 is machined into the exterior of subsection 260*a* below recess 270. Control slot 272 and indexing pin 271 cooperate to cause incremental rotation of second mandrel means 260 relative to first mandrel means 245 when second mandrel means 260 moves longitudinally relative thereto. The degree of rotation is directly proportional to the angle of control slots 272 relative to the longitudinal axis of first mandrel means 245. More than one indexing pin 271 may be used if desired.

Port means 256 equalizes any difference in pressure between the exterior of indexing tool 242 and annulus 50. Wiper rings 210 and 211 provide another fluid flow path to equalize any difference in pressure between the exterior of indexing tool 242 and annulus 50. Indexing pin 271 may have a hole drilled therethrough to assist with equalizing fluid pressure. The result is that one side of piston means 261 is exposed to fluid pressure in longitudinal flow passageway 46 and the other side exposed to fluid pressure exterior to indexing tool 242.

Matching threads 81 are machined on portion 260*c* of second mandrel means 260 and cleaning tool 80. Threads 81 provide means for attaching various cleaning tools to the portion of second mandrel means 260 extending from first mandrel means 245. Cleaning tool 80 is an oblong vessel having a relatively large fluid chamber 82. Cleaning fluid is supplied to chamber 82 from longitudinal flow passageway 46. A plurality of fluid jets 83 extends laterally through the exterior of cleaning tool 80. Jets 83 allow fluids from longitudinal flow passageway 46 to exit from chamber 82 and to clean the interior of well flow conductor 23 adjacent thereto. Various sizes and types of cleaning tools can be attached to indexing tool 242 corresponding to the sizes of the well flow conductor and the type of deposit to be cleaned. Cleaning tool 80*a* is an enlarged version of cleaning tool 80 for use in large diameter casing. The outside diameter of cleaning tool 80*a* is selected to provide the desired standoff between fluid jets 83 and the interior of flow conductor 22 adjacent thereto. Cleaning tool 80*b* is essentially the same as cleaning tool 80*a* except that it is longer for greater vertical cleaning of a flow conductor.

OPERATING SEQUENCE FOR CONTINUOUS J-SLOT CLEANING TOOL

Figure 6:
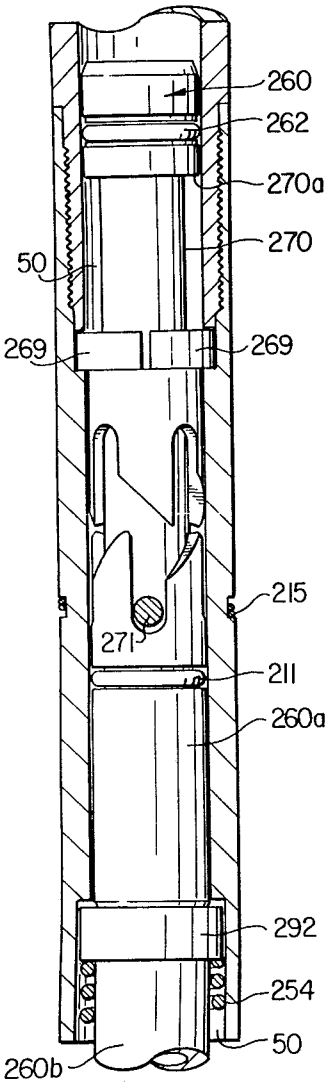

FIGS. 6–10 show the sequence of events as cleaning fluid is supplied to indexing tool 242 and second mandrel means 260 is rotated or indexed relative to first mandrel means 245. Indexing tool 242 is shown in FIG. 6 as it would appear with less fluid pressure applied to piston means 261 than required to overcome springs 254. This condition would exist when well cleaning apparatus 40 was being inserted into a flow conductor without cleaning fluid being pumped through coil tubing 26.

After positioning cleaning apparatus 40 including indexing tool 242 at the desired location in the well flow conductor, cleaning fluid pressure is supplied to longitudinal flow passageway 46 from manifold 28 via coil tubing 26. When cleaning fluid pressure acting on piston means 261 exceeds the pressure of any fluid in annulus 50 and the force of spring 254 second mandrel means 260 will move longitudinally relative to first mandrel means 245 until fully extended. During this extension of second mandrel means 260, indexing pin 271 and control slot 272 cooperate to rotate or index second mandred means 260. See FIG. 7.

Figure 8:
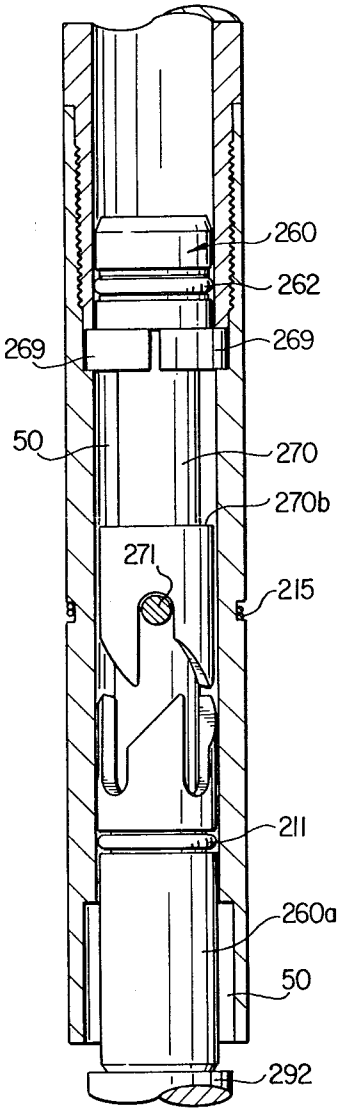
Figure 7:
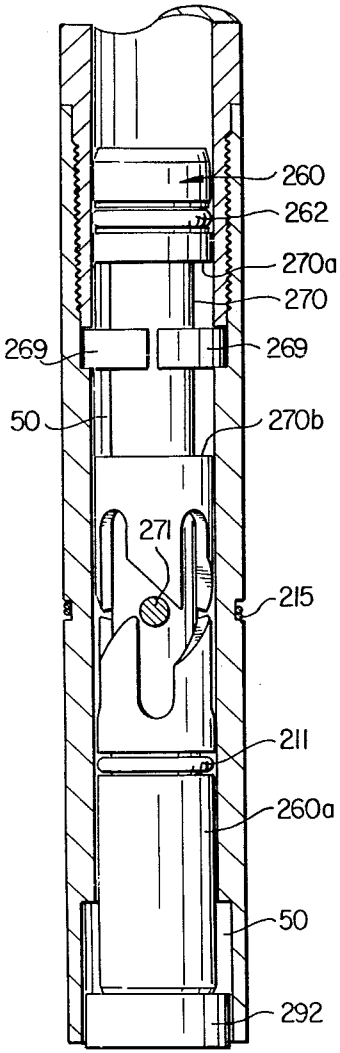

In FIG. 8, second mandrel means 260 is shown in its fully extended position relative to first mandrel means 245. Indexing tool 242 will remain in this position as long as cleaning fluid pressure in longitudinal flow passageway 46 applies more force to piston means 261 than spring 254 and any fluid pressure in annulus 50. FIG. 8 represents the normal position for indexing tool 242 while jet cleaning downhole deposits.

Figure 5:
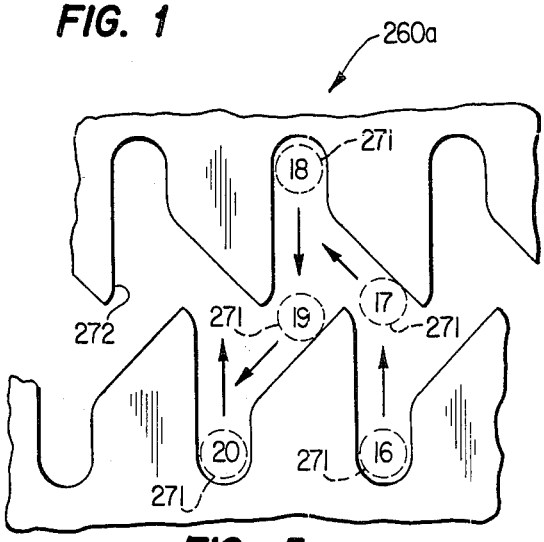
FIG. 5 is a development view showing the control slot or continuous J-slot on the inner mandrel of FIG. 4 and the relative position of an indexing pin as it moves therein to translate longitudinal movement into rotation.

Inner mandrel means 260 can be rotated to position jets 83 of cleaning tool 80 adjacent to different portions of the interior of the flow conductor being cleaned. By decreasing cleaning fluid pressure in longitudinal flow passageway 46 below a preselected value, spring 254 can retract or move second mandrel means 260 longitudinally upward. A temporary pressure decrease is possible by opening and closing valve 35 at the well surface. As second mandrel means 260 moves upward, indexing pin 271 and control slot 272 cause further rotation of second mandrel means 260. See FIGS. 9 and 10. When the upward movement has been completed, second mandrel means 260 will have rotated the angular distance between position 16 and 20 of FIG. 5. Second mandrel means 260 is partially rotated during both downward and upward movement. Thus, a series of cleaning fluid pressure changes can rotate second mandrel means 260 and any cleaning tool attached thereto through three hundred and sixty degrees. FIG. 5 shows the relative positions of indexing pin 271 as it moves through control slot 272 in FIGS. 6–10. U.S. Pat. Nos. 4,420,044 and 4,583,592 provide additional details concerning the design and manufacture of continuous J-slots.

The previous description is illustrative of only some embodiments of the present invention. Those skilled in the art will readily see other variations and modifications without departing from the scope of the invention as defined in the claims.

What is claimed is:

1. Apparatus for cleaning flow conductors comprising:

a. first mandrel means and second mandrel means with a longitudinal flow passageway extending through each;

b. means for connecting one end of the first mandrel means to a source of cleaning fluid;

c. the second mandrel means slidably disposed within the first mandrel means and a portion of the second mandrel means extending from the other end of the first mandrel means;

d. means for rotating the second mandrel means relative to the first mandrel means in response to fluid pressure changes within the longitudinal flow passageway;

e. the rotating means including a continuous J-slot and an indexing pin; and f. means for attaching a cleaning tool to the portion of the second mandrel means extending from the first mandrel means.

2. Apparatus as defined in claim 1 wherein the means for rotating the second mandrel means comprises:

a. piston means attached to the second mandrel means;

b. one side of the piston means exposed to fluid pressure within the longitudinal flow passageway and the other side of the piston means exposed to fluid pressure exterior to the first mandrel means whereby fluid pressure on the one side of the piston means will move the second mandrel means longitudinally to a further extended position relative to first mandrel means; and c. means for biasing the second mandrel means to retract from its further extended position.

3. Apparatus as defined in claim 2 comprising the indexing pin secured to one of the mandrel means and the continuous J-slot formed in the other mandrel means to receive the indexing pin therein.

4. Apparatus as defined in claim 3 wherein the piston means, indexing pin and continuous J-slot comprise means for translating longitudinal movement of the second mandrel means into rotational movement.

5. Apparatus as defined in claim 4 wherein the translating means further comprises:

a. the indexing pin secured to the first mandrel means;

b. the continuous J-slot machined in the exterior of the second mandrel means; and c. the indexing pin positioned in the J-slot.

6. Apparatus as defined in claim 1 further comprising:

a. small diameter tubing providing the source of cleaning fluid; and b. the first mandrel means sized to be disposed within a downhole well tubular.

* * * * *